US009139409B2

(12) United States Patent
Perron

(10) Patent No.: US 9,139,409 B2
(45) Date of Patent: Sep. 22, 2015

(54) WEIGHTED BOOM ASSEMBLY

(71) Applicant: Oshkosh Corporation, Oshkosh, WI (US)

(72) Inventor: Jacob J. Perron, Chambersburg, PA (US)

(73) Assignee: Oshkosh Corporation, Oshkosh, WI (US)

( * ) Notice: Subject to any disclaimer, the term of this patent is extended or adjusted under 35 U.S.C. 154(b) by 86 days.

(21) Appl. No.: 13/797,720

(22) Filed: Mar. 12, 2013

(65) Prior Publication Data

US 2014/0271076 A1 Sep. 18, 2014

(51) Int. Cl.
*B66C 23/68* (2006.01)
*B66F 11/04* (2006.01)

(52) U.S. Cl.
CPC ..... *B66F 11/046* (2013.01)

(58) Field of Classification Search
USPC ..... 212/177, 278, 299, 309, 195, 347
See application file for complete search history.

(56) References Cited

U.S. PATENT DOCUMENTS

| | | | | |
|---|---|---|---|---|
| 3,917,200 | A * | 11/1975 | Johnson | 248/647 |
| 4,081,081 | A * | 3/1978 | Morrow et al. | 212/178 |
| 4,646,875 | A | 3/1987 | Sholl | |
| 4,907,768 | A | 3/1990 | Masseron et al. | |
| 4,969,789 | A | 11/1990 | Searle | |
| 5,249,643 | A | 10/1993 | Backer et al. | |
| 5,669,517 | A | 9/1997 | Donaldson et al. | |
| 5,704,498 | A | 1/1998 | Smith et al. | |
| 6,098,823 | A | 8/2000 | Yahiaoui | |
| 6,341,665 | B1 | 1/2002 | Zhou et al. | |
| 6,390,312 | B1 | 5/2002 | Bean | |
| 6,450,706 | B1 | 9/2002 | Chapman | |
| 6,488,161 | B1 * | 12/2002 | Bean | 212/300 |
| 6,508,019 | B1 * | 1/2003 | Sasaki et al. | 37/466 |
| 7,014,054 | B2 | 3/2006 | Yahiaoui et al. | |
| 7,246,684 | B2 | 7/2007 | Bean | |
| 7,695,072 | B2 | 4/2010 | Orgård | |
| 7,762,412 | B2 | 7/2010 | Porubcansky | |
| 8,056,674 | B2 | 11/2011 | Bean et al. | |
| 8,308,000 | B2 | 11/2012 | Wiesbauer | |

(Continued)

FOREIGN PATENT DOCUMENTS

| | | |
|---|---|---|
| EP | 0 832 841 | 4/1998 |
| EP | 0 978 427 | 2/2000 |

(Continued)

OTHER PUBLICATIONS

International Search Report and Written Opinion for PCT/US2014/018867, dated May 15, 2014, 13 pages.

*Primary Examiner* — Emmanuel M Marcelo
(74) *Attorney, Agent, or Firm* — Foley & Lardner LLP

(57) ABSTRACT

A boom assembly includes a lower boom, an intermediate member, an upper boom, an intermediate link, and an actuator coupled between the intermediate member and the upper boom. The lower boom includes an intermediate member end and a base end, and the base end is configured to be pivotally coupled to a lift device. The intermediate member is pivotally coupled to the intermediate member end of the lower boom. The upper boom includes a first end pivotally coupled to the intermediate member, and the intermediate link is coupled directly between the upper boom and the lower boom. The intermediate member includes a base portion positioned to carry structural loading and a weighted portion positioned to provide counterweight for the lift device.

17 Claims, 10 Drawing Sheets

(56) References Cited

U.S. PATENT DOCUMENTS

| | | | | |
|---|---|---|---|---|
| 8,522,988 | B2 * | 9/2013 | Tanaka et al. | 212/300 |
| 2003/0126772 | A1 * | 7/2003 | Masumoto et al. | 37/466 |
| 2005/0224439 | A1 | 10/2005 | Bean et al. | |
| 2009/0134109 | A1 * | 5/2009 | Shimoie | 212/347 |
| 2011/0168490 | A1 * | 7/2011 | Donaldson | 182/63.1 |

FOREIGN PATENT DOCUMENTS

| | | |
|---|---|---|
| WO | WO-01/83357 | 11/2001 |
| WO | WO-01/92952 | 12/2001 |

* cited by examiner

WEIGHTED BOOM ASSEMBLY

BACKGROUND

The present application relates to a boom for a lift device. More particularly, the present application relates to a weighted boom assembly that reduces tail and chassis counterweight.

Traditional single tower articulated boom lifts may include a chassis and a turntable coupled to the chassis. An end of a first boom section is coupled to the turntable, and an opposing end of the first boom section is coupled to a second boom section with an upright. A lift cylinder elevates the first boom section and the second boom section thereby elevating an implement (e.g., work platform, forks, etc.) that is coupled to an end of the second boom section.

The lift device may experience forward instability as the implement is elevated (e.g., due to a cantilevered force applied to the implement. A counterweight coupled to the tail of turntable (i.e. a tail counterweight) or coupled to the chassis of lift device (e.g., a chassis counterweight) reduces forward instability by generating a counterbalance moment that opposes the destabilizing moment generated by the force on the implement. The lift device may also experience backward instability as the implement is elevated and the angle between the boom sections increases. It should be understood that tail counterweight may generate a destabilizing moment and contribute to backward instability. Traditional lift devices include significant tail and chassis counterweight to reduce forward and backward instability. However, such tail and chassis counterweight increases the overall weight of the lift device.

SUMMARY

One embodiment of the invention relates to a boom assembly that includes a lower boom, an intermediate member, an upper boom, an intermediate link, and an actuator coupled between the intermediate member and the upper boom. The lower boom includes an intermediate member end and a base end, and the base end is configured to be pivotally coupled to a lift device. The intermediate member is pivotally coupled to the intermediate member end of the lower boom. The upper boom includes a first end pivotally coupled to the intermediate member, and the intermediate link is coupled directly between the upper boom and the lower boom. The intermediate member includes a base portion positioned to carry structural loading and a weighted portion positioned to provide counterweight for the lift device.

Another embodiment relates to a boom assembly that includes a lower boom, an intermediate member, an upper boom, and a ballast. The lower boom includes an intermediate member end and a base end, and the base end is configured to be pivotally coupled to a lift device. The intermediate member is pivotally coupled to the intermediate member end of the lower boom. The upper boom includes a first end pivotally coupled to the intermediate member. The ballast is coupled to the intermediate member and positioned to provide counterweight for the lift device.

Yet another embodiment relates to a lift device that includes a chassis and a boom assembly coupled to the chassis and moveable between a lowered position and an elevated position. The boom assembly includes a lower boom, an intermediate member, an upper boom, and a ballast. The lower boom includes an intermediate member end and a base end that is that is coupled to the chassis. The intermediate member is pivotally coupled to the intermediate member end of the lower boom, and the upper boom includes an intermediate end pivotally coupled to the intermediate member. The ballast is coupled to the intermediate member and positioned to provide counterweight for the lift device.

The invention is capable of other embodiments and of being carried out in various ways. Alternative exemplary embodiments relate to other features and combinations of features as may be generally recited in the claims.

BRIEF DESCRIPTION OF THE DRAWINGS

The invention will become more fully understood from the following detailed description taken in conjunction with the accompanying drawings wherein like reference numerals refer to like elements, in which.

DETAILED DESCRIPTION

Figure 1:
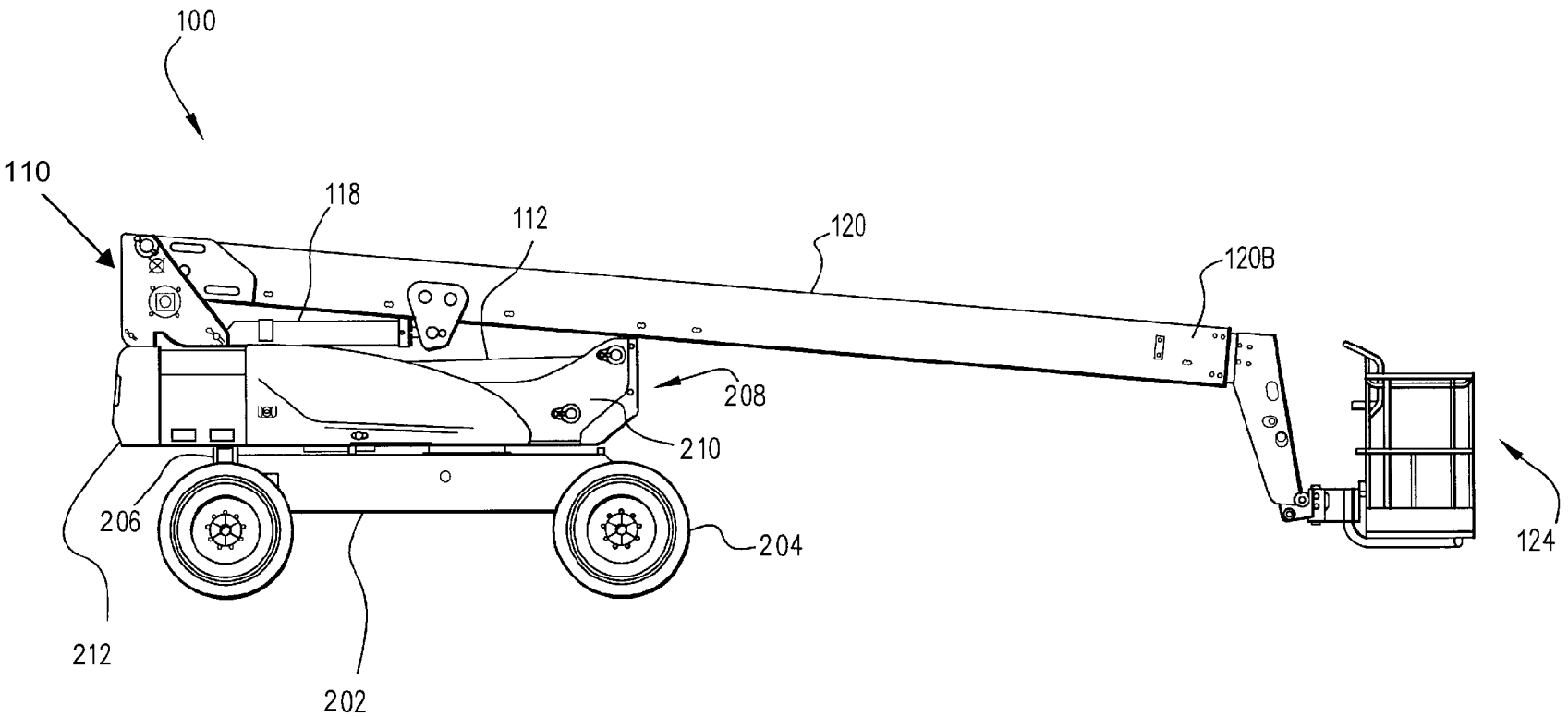
FIG. 1 is a side view of a lift device including a boom assembly, according to an exemplary embodiment.

Referring to the exemplary embodiment shown in FIG. 1, a lift device (e.g., aerial work platform, telehandler, etc.), shown as a lift device 100, includes a boom assembly, shown as a boom 110, coupled to a base. The boom lift also includes an implement, shown as platform assembly 124, coupled to an end of the boom 110. According to an exemplary embodiment, the base includes a vehicle chassis 202 and a supporting base structure 208 that is supported by the vehicle chassis 202. As shown in FIG. 1, the vehicle chassis 202 is supported by a plurality of wheels 204. According to an exemplary embodiment, the wheels 204 are driven by a drive system 206. The drive system 206 may be controlled with a controlling mechanism. The drive system may be controlled from a cab, a control panel at the supporting base structure 208, a control panel at the platform assembly 124, or from still another location. The supporting base structure 208 includes a turntable 210 rotatable relative to the vehicle chassis 202 and a tail counterweight 212.

Figure 2:
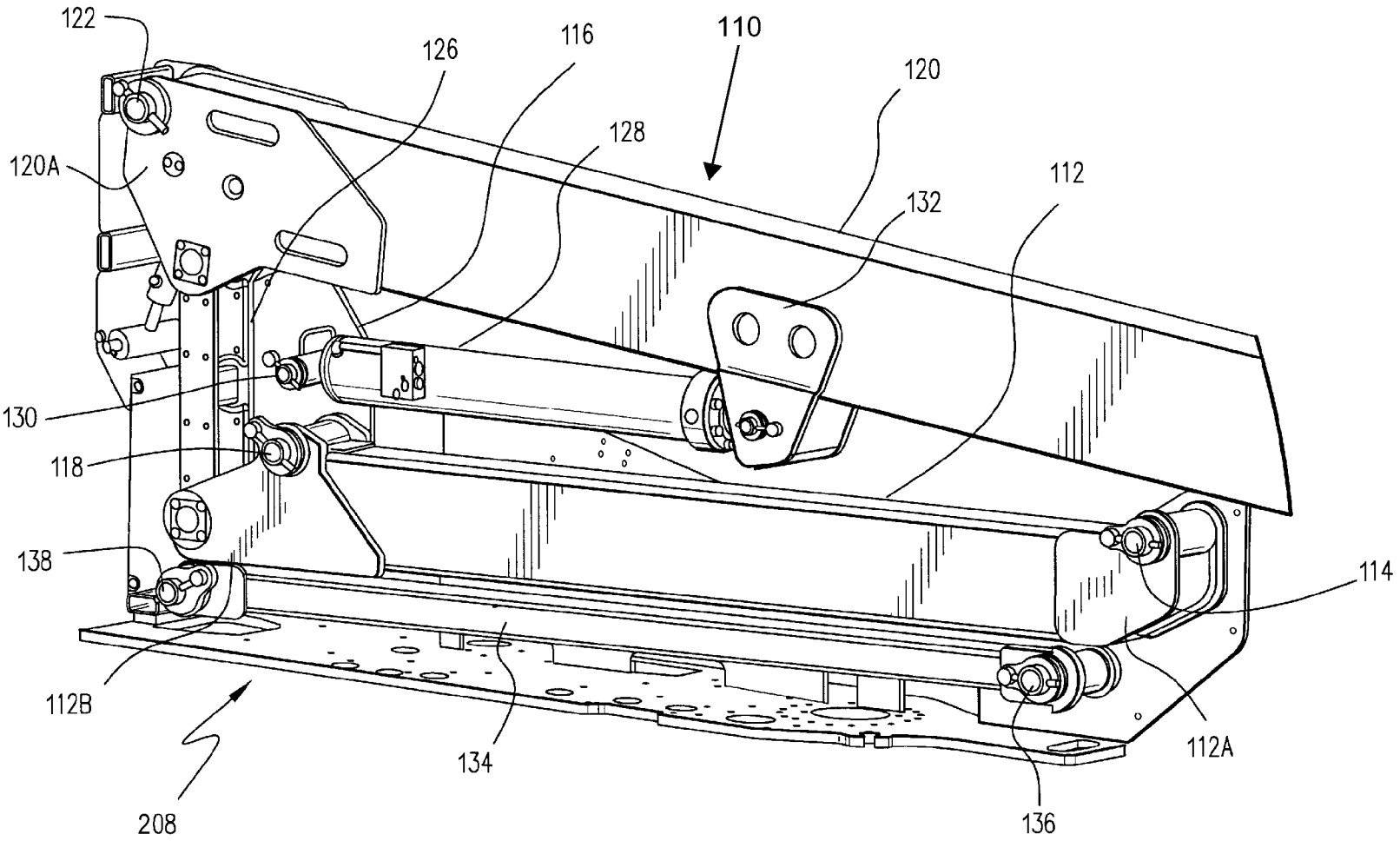
FIG. 2 is a perspective view of a boom assembly, according to an exemplary embodiment.
Figure 3:
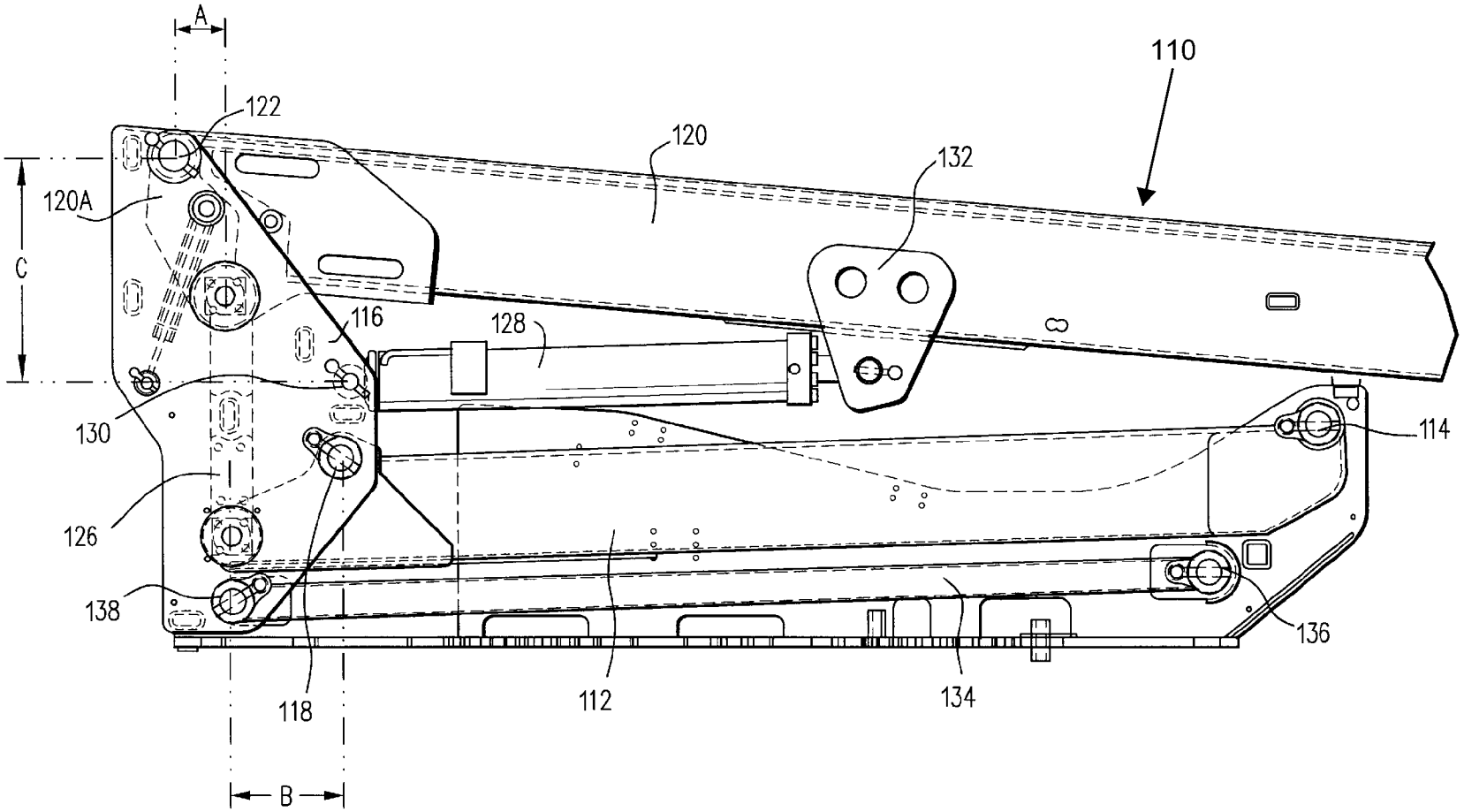
FIG. 3 is a side view of a boom assembly in a lowered position, according to an exemplary embodiment.

Referring to the exemplary embodiment shown in FIGS. 1-3, the boom 110 is shown coupled to the supporting base structure 208. The boom 110 includes a lower boom, shown as a tower boom 112, an upper boom, shown as a main boom 120, and an intermediate member coupling the tower boom 112 to the main boom 120, shown as an upright 116. A portion of the upright 116 is removed in FIG. 2 to show internal components of the boom 110. According to an exemplary embodiment, the main boom 120 has a length that is greater than tower boom 112. According to an exemplary embodiment, the main boom 120 is a telescopic boom capable of extending or retracting along a longitudinal centerline. The tower boom 112 is pivotally coupled to the supporting base structure 208 at a base end 112A with a base pivot 114. According to an exemplary embodiment, the tower boom 112 is pinned to the turntable 210 with the base pivot 114. An upright end 112B of the tower boom 112 is pivotally coupled to the upright 116 at a tower boom nose pivot 118. The main boom 120 is pivotally coupled at its base end 120A to the upright 116 with a main boom pivot 122. An intermediate link, shown as a timing link 126, is connected between the tower boom 112 and the main boom 120 at the upright end 112B of the tower boom 112 and the base end 120A of the main boom 120. A lower link, shown as a tower link 134, fixes the orientation of the upright 116 relative to the supporting base structure 208. The tower link 134 is pivotally coupled at a first end end to the base structure with a tower link pivot 136. According to an exemplary embodiment, the tower link 134 is coupled at a second end to the upright 116 with a pivot 138.

As shown in FIG. 1, an extending end 120B (e.g., distal end) of the main boom 120 supports a load with the platform assembly 124. According to an exemplary embodiment, the platform assembly 124 is a structure that is capable of supporting one or more workers. According to some embodiments, an accessory or tool may be coupled to the platform assembly 124 for use by a worker. Such tools include, among others, pneumatic tools (e.g., impact wrench, airbrush, nail gun, ratchet, etc.), plasma cutters, welders, and spotlights.

According to an exemplary embodiment, the boom 110 includes an actuator (e.g., pneumatic cylinder, electric actuator, hydraulic cylinder, etc.), shown as a lift cylinder 128, that raises and lowers the platform assembly 124 and the load therein. According to an exemplary embodiment, the lift cylinder 128 is coupled between the upright 116 and the main boom 120 with a lift pivot 130 and a lift attaching frame 132, respectively. The lift cylinder 128 is pinned to the upright 116 with the lift pivot 130. The lift attaching frame 132 is coupled (e.g., welded) to the main boom 120. According to an alternative embodiment, the lift cylinder 128 is coupled to another portion of boom 110. By way of example, the lift cylinder 128 may be coupled between the supporting base structure 208 and the tower boom 112, between the tower boom 112 and the upright 116, between the tower boom 112 and a tower link 134 (e.g., at opposite corners of the parallelogram, etc.), between the tower boom 112 and the main boom 120, or in still another position.

Figure 4:
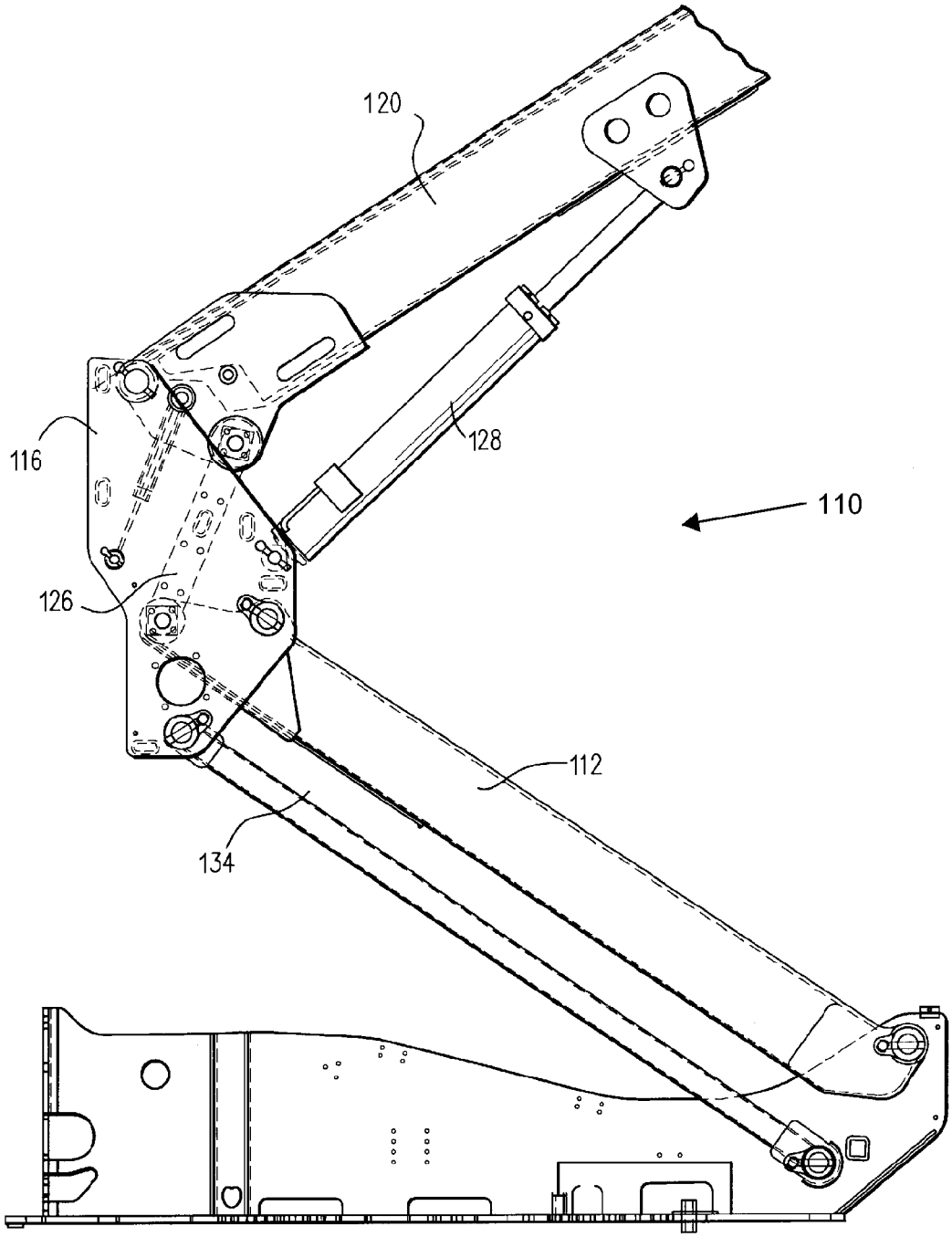
FIG. 4 is a side view of a boom assembly in an intermediate position, according to an exemplary embodiment.
Figure 5:
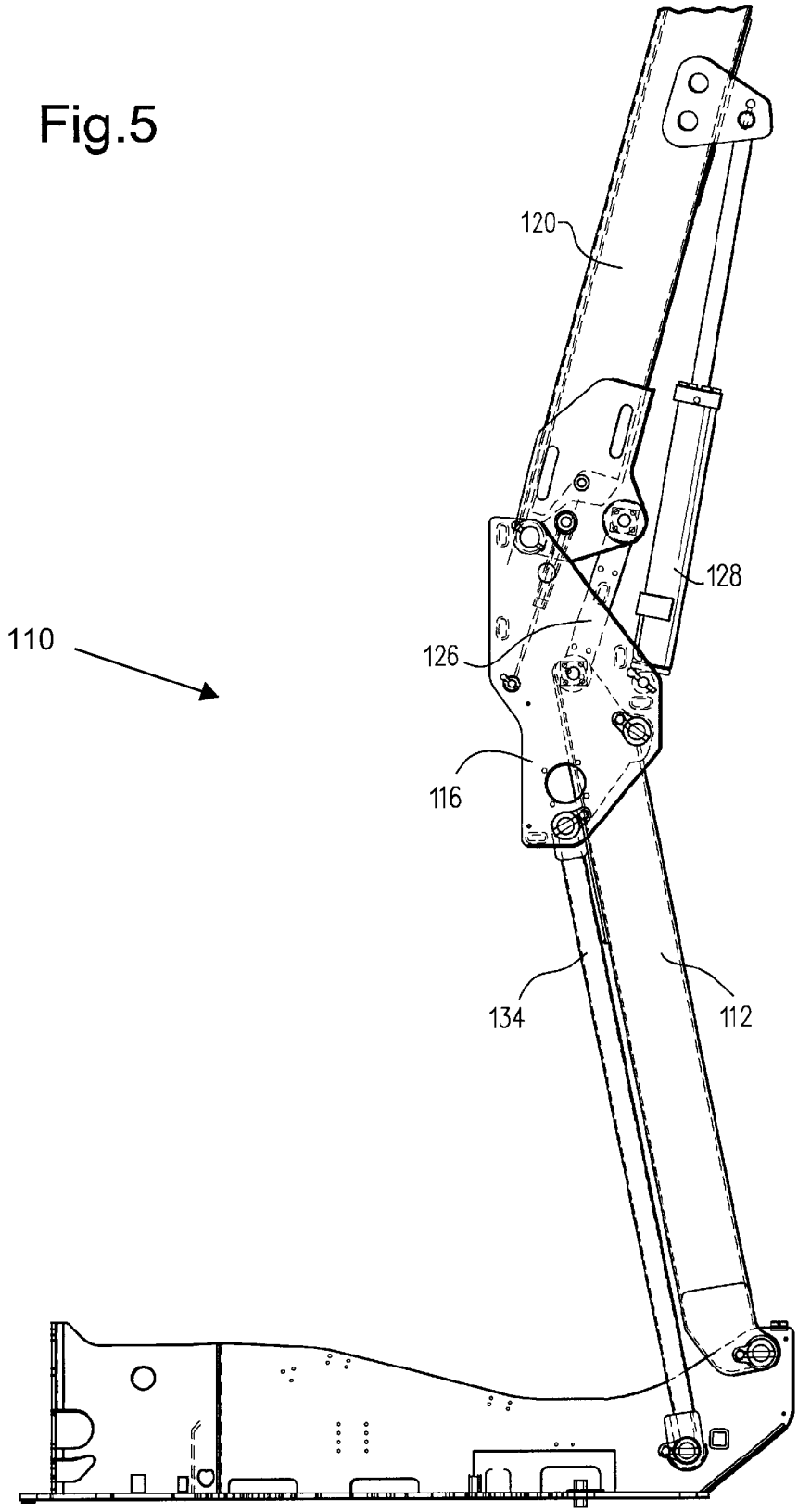
FIG. 5 is a side view of a boom assembly in an elevated position, according to an exemplary embodiment.

According to the exemplary embodiment shown in FIGS. 3-5, the boom 110 is shown in various positions. As shown in FIG. 3, the boom 110 is positioned a lowered position, and the tower boom 112 extends from a first end in a first direction. The main boom 120 is coupled to the tower boom 112 with an upright 116 and extends in an opposing direction. As shown in FIG. 4, the boom 110 is positioned in an intermediate position. As shown in FIG. 5, the boom 110 is positioned in an elevated position.

According to an exemplary embodiment, boom 110 is articulated between various positions as lift cylinder 128 is extended and retracted. As shown in FIG. 3, lift pivot 130 is offset a distance C from the main boom pivot 122. Extension of the lift cylinder 128 along an extension axis (e.g., along a rod of lift cylinder 128) thereby generates a moment about the main boom pivot 122. The moment generates angular motion of the main boom 120 relative to the upright 116 (e.g. counterclockwise motion, etc.) about the main boom pivot 122.

As shown in FIGS. 3-5, the angular motion of the main boom 120 about the main boom pivot 122 generates angular motion of the tower boom 112. According to an exemplary embodiment, the angular motion of the main boom 120 is related to the angular motion of the tower boom 112 (e.g., equal, related by a fixed ratio, a variable ratio, etc.). The timing link 126 is coupled to the main boom 120 at a position spaced from the main boom pivot 122 by a distance A such that a linking force is generated in the timing link 126 as the main boom 120 rotates about the main boom pivot 122. As shown in FIG. 3, the timing link 126 is coupled to the tower boom 112 at a location that is spaced a distance B from the tower boom nose pivot 118. The linking force thereby generates a moment about the tower boom nose pivot 118. Angular motion of the main boom 120 therefore causes rotation and translation of the timing link 126 relative to the upright 116 that, in turn, causes an angular motion of the tower boom 112 relative to the upright (e.g., clockwise motion).

According to an exemplary embodiment, the change in angle between the upright 116 and the main boom 120 is greater than the change in angle between the upright 116 and the tower boom 112. As shown in FIG. 3, the tower link 134 and the tower boom 112 form a four-bar linkage or parallelogram. According to an exemplary embodiment, the upright 116 has a fixed orientation (e.g., level, plumb) relative to a ground surface. The fixed orientation of upright 116 facilitates relative motion of the tower boom 112 about the tower boom nose pivot 118 that is generated by timing link 126.

According to an alternative embodiment, the boom 110 does not include the tower link 134. In one such embodiment, the upright 116 is maintained in a level position with a master and slave combination of actuators (e.g., hydraulic cylinders, pneumatic cylinders, electric actuators, etc.) positioned between the turntable 210 and the upright 116 and between the upright 116 and the main boom 120. A leveling system, (e.g., a feedback leveling system) may be implemented for leveling the platform assembly 124 or still other components of boom 110.

According to an exemplary embodiment, changing the angle of the tower boom 112 compensates for the change in angle of the main boom 120 thereby reducing the amount of horizontal movement of the platform assembly 124 during articulation of the boom 110. Including a tower boom 112 and a main boom 120 coupled with an upright 116 as shown in FIG. 3 offers improved comfort for the operator of the boom assembly. Such a configuration may also reduce the amount of repositioning required to make repeated vertical adjustments (e.g., to replace windows, to complete jobs requiring repeated vertical adjustments, etc.).

Figure 6:
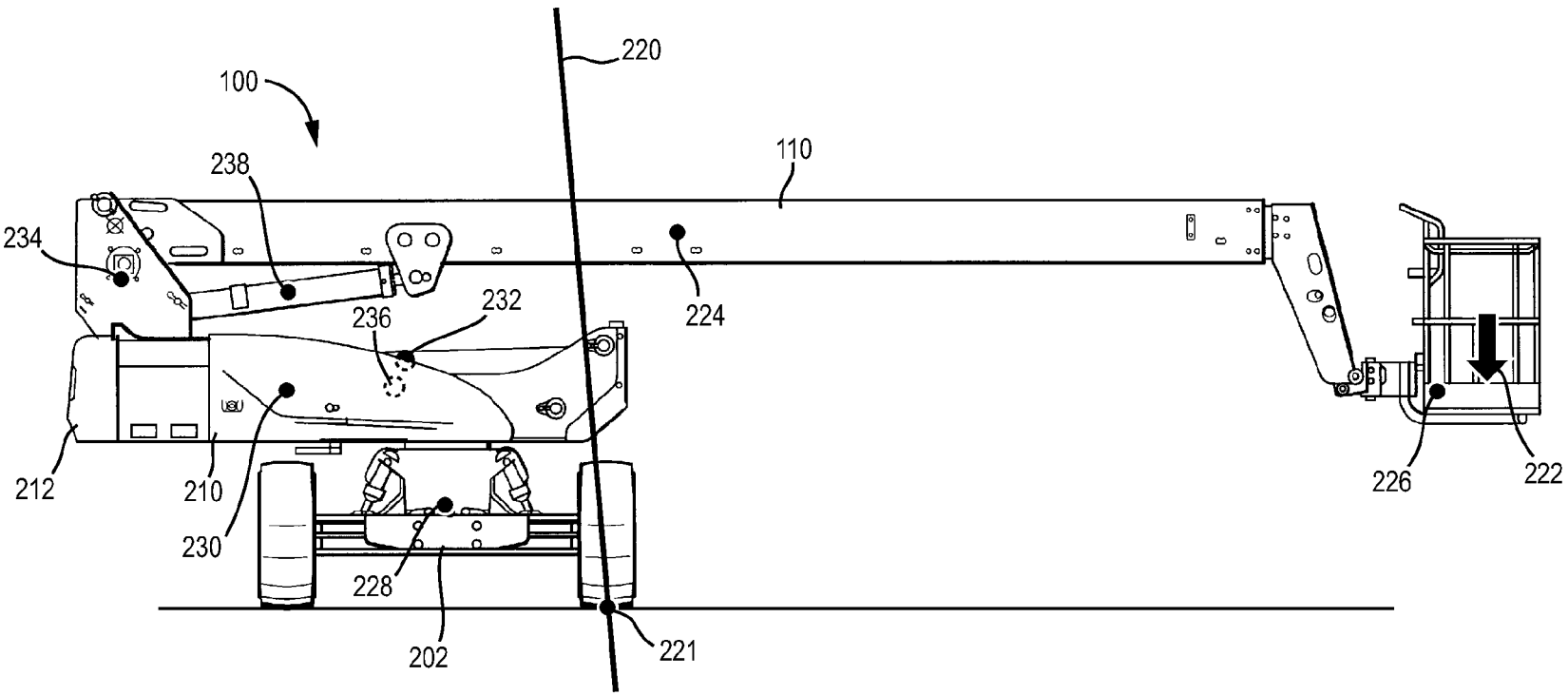
FIG. 6 is a side view of a lift device with the boom assembly in a position of forward instability, according to an exemplary embodiment.
Figure 7:
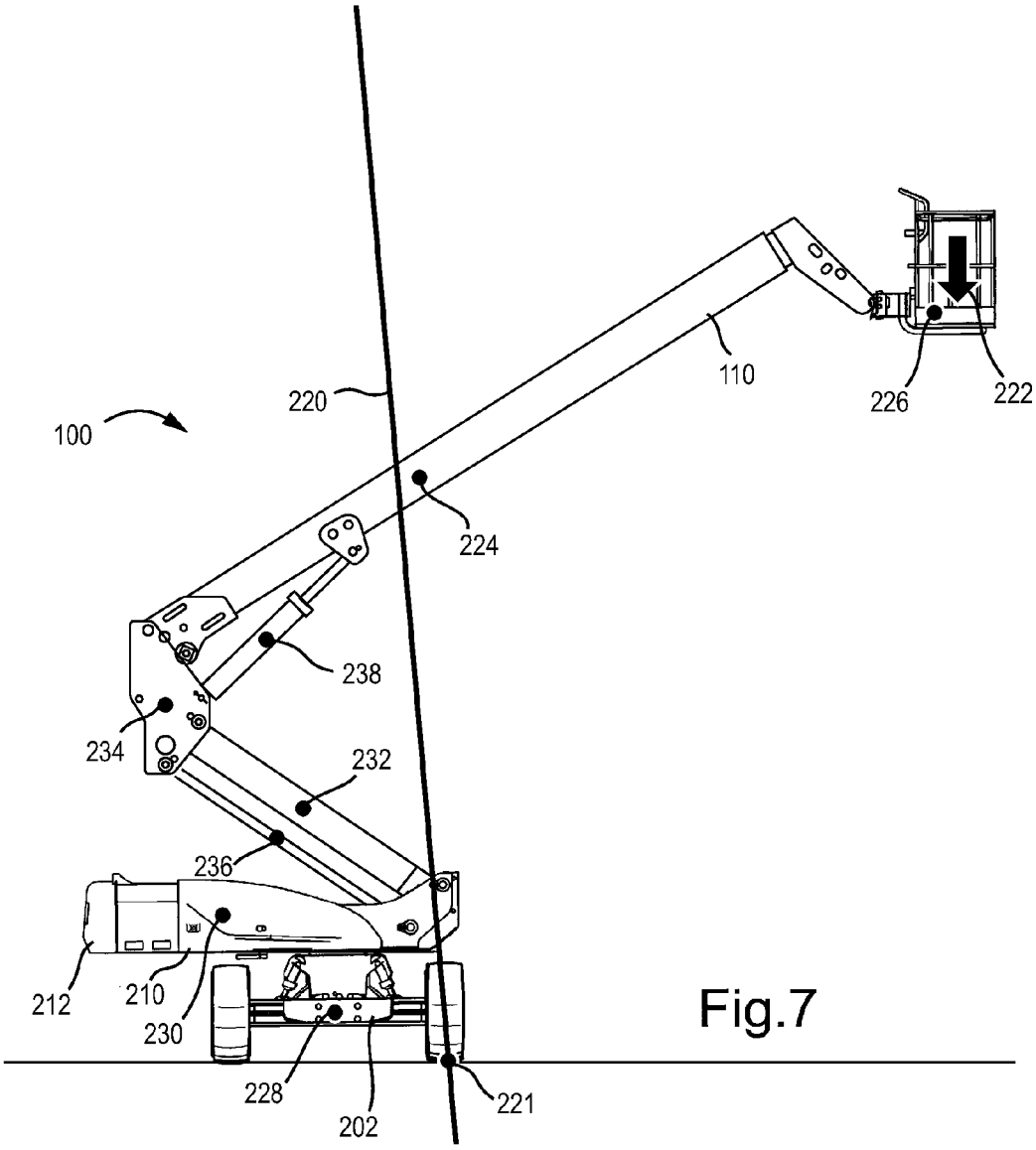
FIG. 7 is a side view of a lift device with the boom assembly in an intermediate position, according to an exemplary embodiment.
Figure 8:
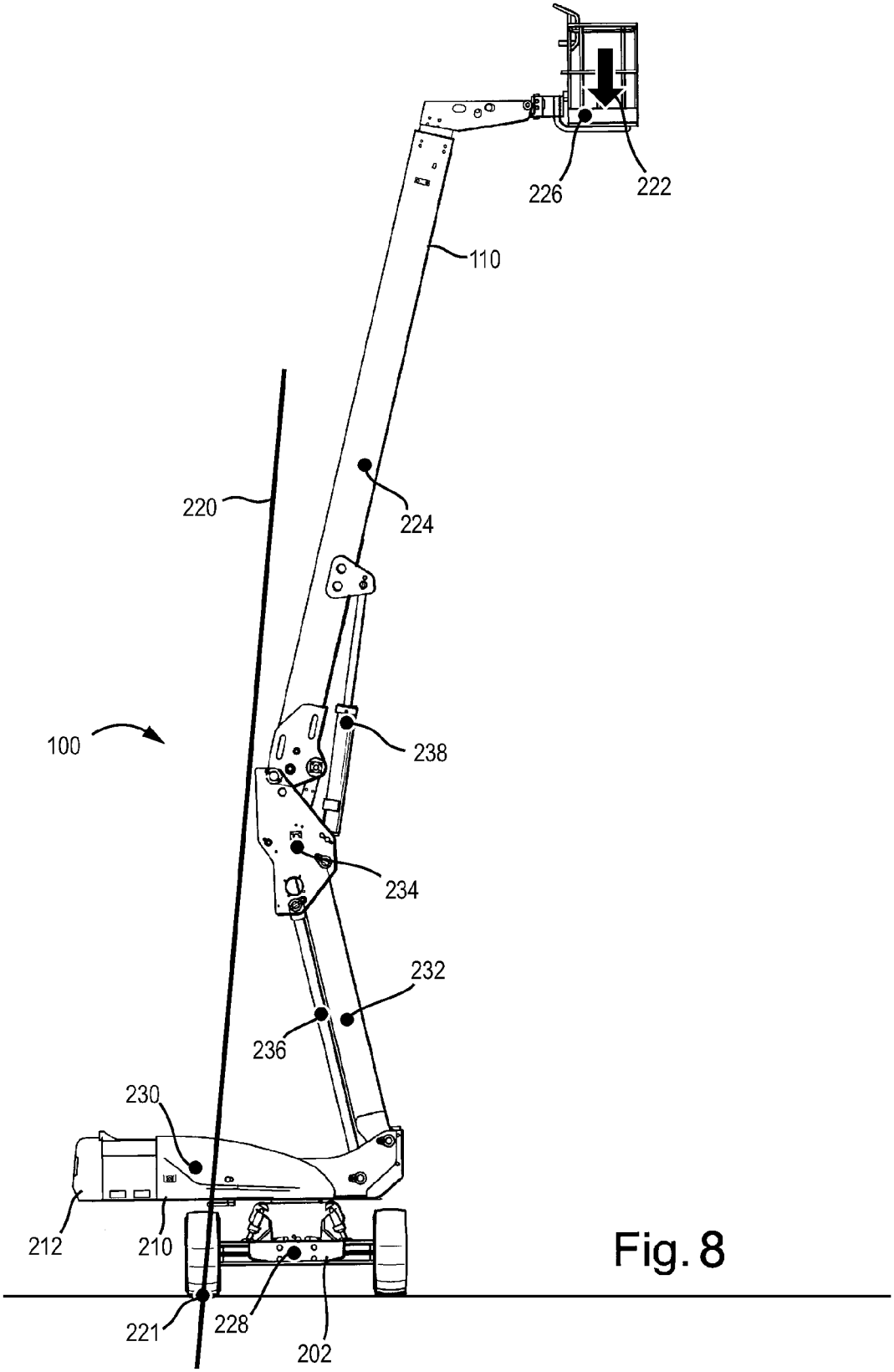
FIG. 8 is a side view of a lift device with the boom assembly in a position of backward instability, according to an exemplary embodiment.

Referring next to the exemplary embodiment shown in FIGS. 6-8, the stability of the lift device 100 is related to the position of boom 110 and the load applied to the implement. According to an exemplary embodiment, the lift device 100 is a wheeled boom lift and a tip point 221 (e.g., the center upon which the lift device 100 would rotate during an instability event) is located at a first set of wheels (e.g., the wheels closest to a load 222 applied to the implement). As shown in FIGS. 6-8, the stability of the lift device 100 is also related to the position of centers of gravity for the various components of the lift device 100 relative to a tip line 220 passing through the tip point 221. According to an exemplary embodiment, the tip line 220 is angularly offset from a vertical line by an angle of five degrees in a direction towards the center of the wheelbase for lift device 100. According to another exemplary embodiment, the tip line 220 may be inclined at another angle (e.g., ten degrees, etc.) or the tip line 220 may be positioned along the vertical axis. In some embodiments, the tip line 220 is intended to reduce the likelihood of an instability event occurring and may be related to an industry standard.

Referring to FIG. 6, the lift device 100 is shown in a lowered position with the turntable 210 in a disposed laterally relative to a longitudinal axis of the vehicle chassis 202 and the boom 110 parallel to the axles of the wheels. When the boom 110 is configured in the lowered position, a main boom center of gravity 224, a platform center of gravity 226, and the load 222 are positioned on a first lateral side of tip point 221 and tip line 220 thereby generating a forward moment (e.g., tipping moment, destabilizing moment, etc.) about the front wheels (e.g., in the clockwise direction, etc.).

According to an exemplary embodiment, a tail counterweight 212 is positioned on a second lateral side of the tip point 221 and the tip line 220. As shown in FIG. 6, the tail counterweight 212 is positioned on an opposing side of the tip line 220 from the load 222. A chassis center of gravity 228 and a turntable center of gravity 230 are also positioned on the opposite side of the tip line 220 from the load 222. Together, the tail counterweight 212, the chassis center of gravity 228 and the turntable center of gravity 230 generate a backward moment about the front wheels. The second set of wheels interfaces with a ground surface that applies a countering force to stabilize the lift device 100. Further backward moments are generated by other components of the boom 110. A tower boom center of gravity 232, an upright center of gravity 234, a tower link center of gravity 236, and a lift cylinder center of gravity 238 are positioned on second lateral side of the tip point 221 and the tip line 220. As shown in FIG. 6, the tower boom center of gravity 232, upright center of gravity 234, tower link center of gravity 236, and lift cylinder center of gravity 238 are located a maximum lateral distance from the tip point 221 and the tip line 220 when the boom 110 is configured in the lowered position.

Referring to FIG. 7, the boom 110 is shown in an intermediate position (e.g., with the main boom 120 at an angle of approximately 30 degrees from horizontal). With the main boom 120 raised, the load 222, the main boom center of gravity 224, and the platform center of gravity 226 are positioned closer to the tip line 220. According to an exemplary embodiment, the resulting forward moment about the tip point 221 at the front wheels is reduced when the boom 110 is configured in the intermediate position. As the platform is raised, the tail counterweight 212, the chassis center of gravity 228 and the turntable center of gravity 230 remain stationary and the portion of the backward moment generated by such components remains constant. However, the lateral distance between the tip point 221 and the tip line 220 and the tower boom center of gravity 232, the upright center of gravity 234, the tower link center of gravity 236, and the lift cylinder center of gravity 238 is reduced. As that platform is raised, the portion of the backward moment generated by the tower boom, the upright, the tower link, and the lift cylinder is reduced.

Referring to FIG. 8, the boom 110 is shown in an elevated position. According to an exemplary embodiment, the tip point 221 (e.g., the center upon which the lift device 100 would rotate during an instability event) shifts from the first set of wheels (e.g., the wheels closest to a load 222 applied to the implement) to the second set of wheels (e.g., the wheels furthest from a load 222 applied to the implement. As the boom 110 articulates into the elevated position, the tip line 220 also shifts such that it passes through a tip point 221 at the second set of wheels. With the tip point 221 and tip line 220 at the second set of wheels, forward moments become stabilizing moments and backward moments become destabilizing moments. As shown in FIG. 8, the tail counterweight 212, the chassis center of gravity 228 and the turntable center of gravity 230 remain stationary and the portion of the backward moment generated by such components remains constant. With the tip point 221 and the tip line 220 positioned at the second set of wheels, the chassis center of gravity 228 generates a forward moment. According to an exemplary embodiment, the load 222, the main boom center of gravity 224, and the platform center of gravity 226 generate smaller forward moments than with the boom 110 configured in the elevated position than with the boom 110 configured in the lowered or intermediate positions (e.g., due to the decreased lateral distances between the tip point 221 and the load 222, the main boom center of gravity 224, and the platform center of gravity 226).

As shown in FIG. 8, the position of the tower boom center of gravity 232, the upright center of gravity 234, the tower link center of gravity 236, and the lift cylinder center of gravity 238 shifts as the boom 110 articulates from the lowered position to the elevated position. In the elevated position, the tower boom center of gravity 232, the upright center of gravity 234, the tower link center of gravity 236, and the lift cylinder center of gravity 238 are positioned on the first lateral side of tip point 221 and tip line 220 (e.g., the same lateral side of the tip point 221 and the tip line 220 as the load 222). According to an exemplary embodiment, the lower boom, the intermediate member, the lower link, and the actuator generate a forward moment when the boom 110 is configured in the elevated position. According to an exemplary embodiment, the total forward moment is greater than the total backward moment thereby stabilizing the lift device 100. It should be understood that the total center of gravity of the lift device shifts from a first lateral position to a second lateral position as the boom 110 articulates between the first lateral position and the second lateral position.

According to an exemplary embodiment, the boom 110 reduces the weight of the tail counterweight 212 and the weight of the chassis by positioning various components to counterbalance the destabilizing moments. As shown in FIGS. 6-8, boom 110 positions the components to provide counterbalance as the boom 110 articulates from the lowered position to the elevated position. In the elevated position, the destabilizing moment generated by the tail counterweight 212 is opposed by the weight of the boom 110. In the lowered position, the weight of the upright 116 and the weight of a portion of boom 110 generate moments that oppose the destabilizing moment generated by load 222.

According to an exemplary embodiment, boom includes weighted components having a weight that is greater than a similar component intended only to carry structural loading. The weighted components further reduce the weight of the tail counterweight and the weight of the chassis thereby reducing the weight of the lift device. According to an exemplary embodiment, the boom positions (e.g., shifts) the weight of various components to oppose the destabilizing moment when in the lowered position, the intermediate position, and the elevated position. Positioning the weight of such components provides a counterbalance that is favorably located as the boom articulates through a range of motion. According to an exemplary embodiment, the boom reduces the weight of the lift device.

According to an exemplary embodiment, the weighted boom components decrease the weight of the lift machine by reducing the weight of tail and chassis counterweight. The decrease in weight of the tail and chassis counterweight is greater than the increase in weight due to the weighted boom components, according to an exemplary embodiment. Any combination of the tower boom 112, the upright 116, the tower link 134, the lift cylinder 128, and still other components (e.g., the timing link, pins, and other fasteners, etc.) are weighted, according to various alternative embodiments.

Figure 9:
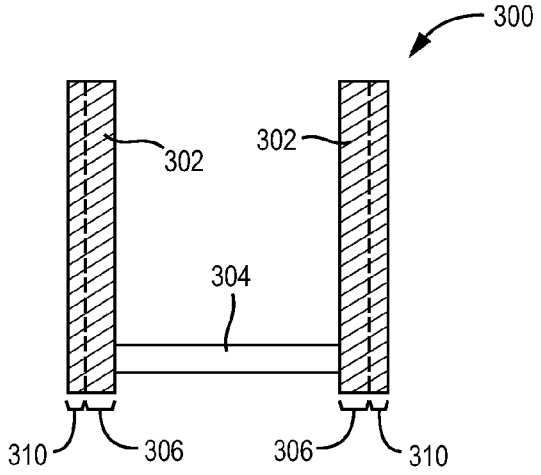
FIG. 9 is a schematic sectional view of an upright for a boom assembly including a base portion and a weighted portion, according to an exemplary embodiment.
Figure 10:
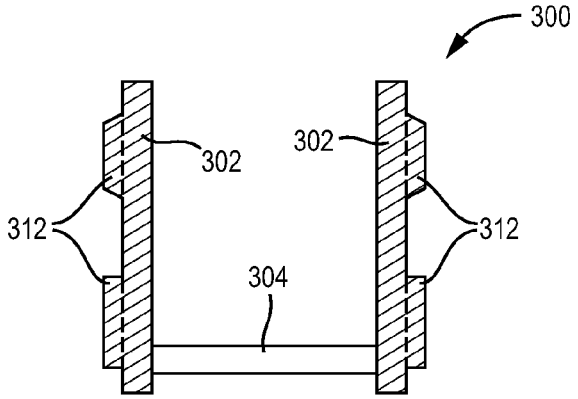
FIG. 10 is a schematic sectional view of an upright for a boom assembly including a discrete boss portion, according to an exemplary embodiment.
Figure 11:
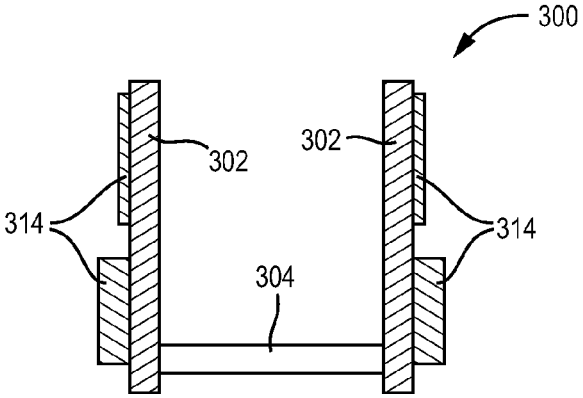
FIG. 11 is a schematic sectional view of an upright for a boom assembly including a discrete weighted portion coupled to a base portion, according to an exemplary embodiment.

Referring to the exemplary embodiments shown in FIGS. 9-11, the intermediate member, shown as weighted upright 300, includes a pair of sidewalls 302 that are coupled by a cross member 304. While FIGS. 9-11 show the intermediate member of a boom assembly, it should be understood that the various components of the boom assembly may be similarly weighted. According to an alternative embodiment, the weighted upright may be otherwise shaped (e.g., as a tubular structure, as s channel, etc.). As shown in FIG. 9, the sidewalls 302 each include a base portion 306 and a weighted portion 310 (i.e. a ballast). According to an exemplary embodiment, the weighted portion 310 is integrally formed with the base portion 306 (e.g., manufactured from the same plate of material having a thickness equal to the thickness of base portion 306 and weighted portion 310). The base portion 306 is positioned to carry structural loading applied to the weighted upright 300 (e.g., due to loading applied to an upper boom of a boom assembly, etc.). The weighted portion 310 is positioned to provide counterweight for the lift device as part of a boom assembly. According to an exemplary embodiment, weighted portion 310 generates a stabilizing moment for the lift device. As shown in FIG. 9, the weighted portion 310 is contiguously coupled (e.g., welded, bolted onto, etc.) to the base portion 306. According to an exemplary embodiment, the weighted portion 310 is uniformly distributed across the base portion 306 (e.g., relative to a plane extending perpendicular to base portion 306 and disposed along a length of weighted upright 300).

Figure 12:
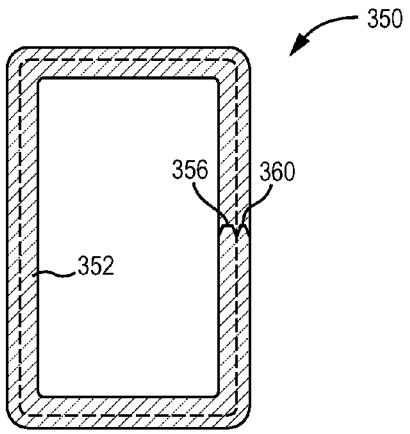
FIG. 12 is a schematic sectional view of a lower boom of a boom assembly including a weighted portion integrally formed with a base portion, according to an exemplary embodiment.

According to the exemplary embodiment shown in FIG. 10, the weighted upright 300 includes a pair of sidewalls 302 that are coupled by a cross member 304. As shown in FIG. 10, the sidewalls 302 form the base portion of weighted upright 300. According to an exemplary embodiment, weighted upright 300 includes a plurality of discrete bosses 312 that form the weighted portion of weighted upright 300. As shown in FIG. 12, the plurality of discrete bosses 312 are non-uniformly distributed across sidewalls 302 (i.e. portions of the sidewalls 302 are not weighted). In some embodiments, the weighted portion is non-uniformly disturbed such that the center of gravity for the intermediate member is positioned further from the tip point or tip line. According to an exemplary embodiment, discrete bosses 312 are disk shaped and extend from an outer surface of sidewalls 302. According to an alternative embodiment, discrete bosses 312 are ribs, ridges, or still other shapes. According to an exemplary embodiment, the location, shape, and size of the discrete bosses 312 is specified to provide counterweight for the lift device without undermining the functionality of the weighted upright 300 (e.g., to provide clearance for coupling mechanisms, the movement of an upper boom or lower boom, etc.).

According to the exemplary embodiment shown in FIG. 11, the weighted upright 300 includes a pair of sidewalls 302 that are coupled by a cross member 304. As shown in FIG. 11, the sidewalls 302 and a plurality of ballasts, shown as bosses 314, are coupled an outer surface of sidewalls 302. The sidewalls 302 form the base portion of the weighted upright 300 and the bosses 314 form the weighted portion of weighted upright 300. According to an exemplary embodiment, bosses 314 comprise a separate component that is coupled (e.g., bolted, welded, adhesively secured, etc.) to the sidewalls 302. According to an alternative embodiment, the bosses 314 are integrally formed with the sidewalls 302. As shown in FIG. 11, bosses 314 have a rectangular cross-sectional shape (e.g., a block, a plate, etc.). According to an alternative embodiment, bosses 314 may have still another shape. As shown in FIG. 11, a first set of bosses 314 have a first thickness and a second set of bosses 314 have a second thickness. Weighted upright 300 having such a distribution of bosses 314 is asymmetrically weighted with the center of gravity of the weighted upright 300 shifted further toward cross member 304 by bosses 314. In other embodiments, the bosses 314 may be disposed in still another arrangement to otherwise distribute the weight of weighted upright 300. According to an exemplary embodiment, the location, shape, and size of the bosses 314 is specified to provide counterweight for the lift device without undermining the functionality of the weighted upright 300 (e.g., to provide clearance for coupling mechanisms, the movement of an upper boom or lower boom, etc.).

As shown in FIGS. 9-11, the weighted portion of the weighted upright 300 is positioned laterally outward (e.g., with respect to a centerline of weighted upright 300) from the base portion. According to an alternative embodiment, the base portion is positioned laterally outward from the base portion. According to still another alternative embodiment, the weighted portion is disposed above, below, or across the base portion. The weighted portions may be added to booms after initial manufacture (e.g., the weighted portion may be added to retrofit existing lift devices) by securing (e.g., with a bolted connection, welding, etc.) the weighted portion to an existing intermediate member thereby reducing the tail counterweight and chassis counterweight. According to other exemplary embodiments the weighted portions may be added to the cross members instead of or in addition to the sidewalls. According to another exemplary embodiment, the weighted portion may include multiple components. For example, the weighted intermediate member may include a first weighted portion formed by increasing the thickness of the base member and may additionally include a second weighted portion (e.g., one or more bosses extending from the first weighted portion).

Figure 13:
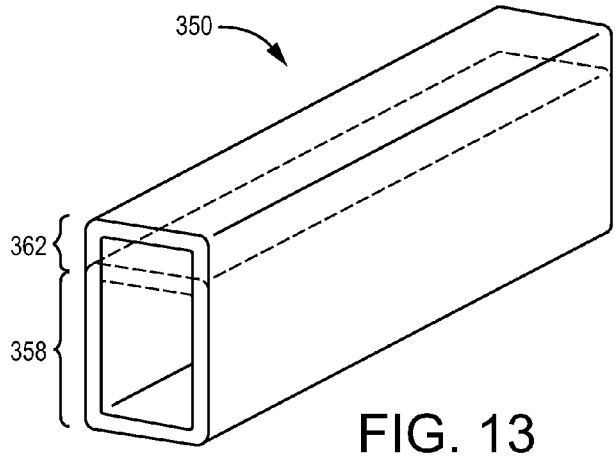
FIG. 13 is a schematic perspective view of a lower boom of a boom assembly including a weighted portion integrally formed with a base portion, according to an exemplary embodiment.
Figure 14:
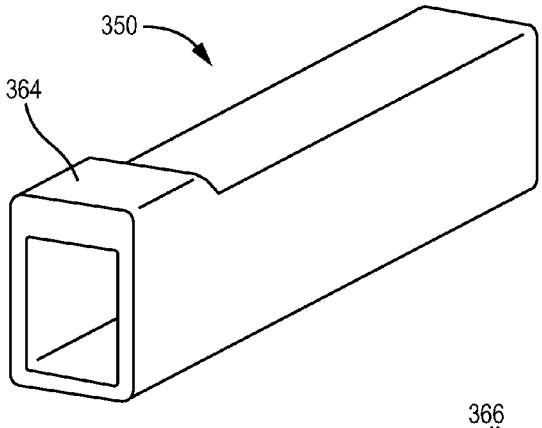
FIG. 14 is a schematic perspective view of a lower boom of a boom assembly including a weighted portion integrally formed with a base portion, according to an exemplary embodiment.

Referring to the exemplary embodiments shown in FIGS. 12-14, the tower boom, shown as weighted tower boom 350 includes plurality of sidewalls that form a tubular cross section. While FIGS. 12-14 show the tower boom of a boom assembly, it should be understood that the various components of the boom assembly may be similarly weighted (e.g., the upper boom, the lower link, etc.). According to the exemplary embodiment shown in FIGS. 12-14, the weighted tower boom 350 includes a base portion and a weighted portion.

As shown in FIG. 12, weighted tower boom 350 includes a tubular cross section 352. The plurality of sidewalls forms a tubular cross section 352 that includes a base portion 356 and a weighted portion 360. According to an exemplary embodiment, tubular cross section 352 forms rectangular tube that defines an internal cavity. The base portion of the weighted tower boom 350, for example, may be a similar size and shape to an upper boom of traditional boom assemblies. It should be understood that weighted portion 360 increases the weight of the weighted tower boom 350 to provide counterweight for a lift device. As shown in FIG. 12, the weighted portion 360 is uniformly distributed along the length of weighted tower boom 350. According to an alternative embodiment, the weighted portion may be positioned along only a portion of weighted tower boom 350 (e.g., symmetrically along the length about a plane extending through a midpoint, asymmetrically along the length, etc.). According to an exemplary embodiment, the weighted portion 360 is integrally formed with the base portion 356 (e.g., manufactured from the same tube of material having a thickness equal to the thickness of base portion 356 and weighted portion 360). The base portion 356 is positioned to carry structural loading applied to the weighted tower boom 350 (e.g., due to loading applied to an upper boom of a boom assembly, etc.). The weighted portion 360 is positioned to provide counterweight for the lift device as part of a boom assembly. According to an alternative embodiment, the weighted portion 360 may be positioned along only a portion of the base portion 356 (e.g., a portion of the tubular cross section 352 may have an increased thickness or include another type of weighted portion 360).

Referring to the exemplary embodiment shown in FIG. 13, the weighted tower boom 350 includes a base portion 358 and a weighted portion formed by a portion 362 of the weighted tower boom having an increased dimension. As shown in FIG. 13, the portion 362 increases the height of the weighted tower boom 350. In other embodiments, another feature (e.g., width, height, depth, diameter, etc.) of the weighted tower boom may have a larger dimension relative to non-weighted tower booms. It should be understood that the total dimension of the weighted tower boom 350 is formed by the base portion 358 and the portion 362 thereby providing structural rigidity and counterweight for the lift device.

Figure 15:
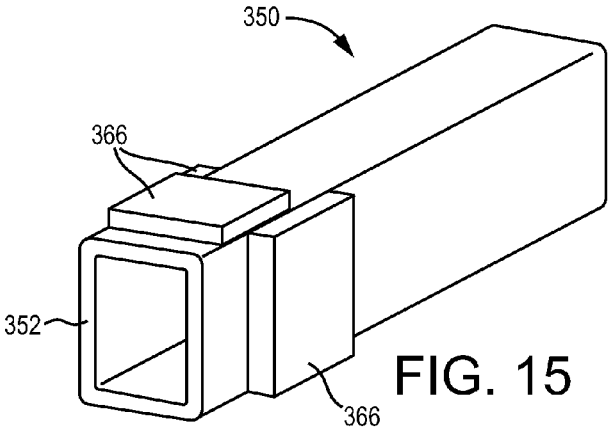
FIG. 15 is a schematic perspective view of a lower boom of a boom assembly including a weighted portion coupled to a base portion, according to an exemplary embodiment.

According to the exemplary embodiment shown in FIG. 14, a weighted portion of the weighted tower boom 350 is one or more raised bosses 364 extending from the tubular cross section 352. The raised boss 364 may be a discrete boss, a plurality of ribs, ridges, or still another shape. According to an exemplary embodiment, the location, shape, and size of the raised bosses 364 are specified to provide counterweight for the lift device without undermining the functionality of the weighted tower boom 350 (e.g., to provide clearance for coupling mechanisms, the movement of an upper boom or lower boom, etc.). Referring next to FIG. 15, a weighted portion of the weighted tower boom 350 is shown, according to another exemplary embodiment. As shown in FIG. 15, the tubular cross section 352 form the base portion of the weighted tower boom 350 and the weighted portion includes a plurality of separate weights 366. According to an exemplary embodiment, the weights 366 are blocks or plates coupled (e.g., welded, bolted, etc.) to the base portion of the weighted tower boom 350. According to an exemplary embodiment, the location, shape, and size of the weights 366 are specified to provide counterweight for the lift device without undermining the functionality of the weighted tower boom 350. The weights 366 may be added to an existing boom 110 to selectively increase the weight of the boom 110 and thereby reducing the tail counterweight and the chassis counterweight. According to the exemplary embodiment shown in FIG. 13, the weighted portion is uniformly distributed along the length of the weighted tower boom 350 and integrally formed with the base portion 358. According to the exemplary embodiment shown in FIGS. 14-15, the weighted portion is asymmetrically distributed along the length of the tower boom (e.g., biased toward a side of the weighted tower boom). In some embodiments, the lower boom and the upper boom of a boom assembly may be asymmetrically weighted having a weighted portion that is biased toward the intermediate member. The weighted portion of such asymmetrical weighting provides a stabilizing moment for the lift device.

The construction of the boom assembly allows the weight of both the base portion and the weighted portions of each component to generate counterweight that resists destabilizing moments. The boom assembly reduces the size of the tail counterweight and chassis counterweight for the corresponding lift device. Including weighted portions thereby reduces the overall weight of the boom lift. By way of example, a conventional lift device capable of a platform height of 80 feet may have a gross weight of approximately 33,300 pounds. A lift device having a boom assembly that includes components with base portions and weighted portions and is capable of a platform height of 80 feet may have a gross weight that is reduced by more than thirty percent (e.g., a gross weight of approximately 20,000 pounds). A lower gross lift device weight has many benefits including smaller, lighter and less expensive components; lighter ground contact pressures of the tires for better floatation on soft terrain as well as reduced interior floor loading; increased battery performance and fuel efficiency; and ease of shipping.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A boom assembly, comprising:

a lower boom including an intermediate member end and a base end configured to be pivotally coupled to a lift device, the lower boom further including a boom base portion that comprises a tubular section positioned to carry structural loading and a boom weighted portion positioned to provide counterweight for the lift device, wherein the boom weighted portion is asymmetrically distributed along the length of the lower boom and biased toward the intermediate member end of the lower boom;

an intermediate member pivotally coupled to an end of the tubular section with a bracket;

an upper boom having a first end pivotally coupled to the intermediate member;

an intermediate link coupled directly between the upper boom and the lower boom; and an actuator coupled between the intermediate member and the upper boom;

wherein the intermediate member includes a base portion including a pair of sidewalls positioned to carry structural loading and a weighted portion positioned to provide counterweight for the lift device, wherein the weighted portion of the intermediate member includes a discrete boss comprising at least one of a disk, a rib, and a ridge.

2. The boom assembly of claim 1, wherein the weighted portion of the intermediate member is contiguously coupled to the base portion of the intermediate member.

3. The boom assembly of claim 1, wherein the weighted portion of the intermediate member is asymmetrically distributed throughout the intermediate member.

4. The boom assembly of claim 1, further comprising an implement coupled to a second end of the upper boom and configured to engage a payload, wherein the base portion of the intermediate member and the boom base portion carry structural loading imparted on the upper boom by the payload and the implement.

5. The boom assembly of claim 4, further comprising a lower link including a lift device end configured to be pivotally coupled to the lift device and an intermediate end pivotally coupled to the intermediate member, the lower link fixing the orientation of the intermediate member relative to a ground surface.

6. The boom assembly of claim 5, wherein the lower link includes a link base portion positioned to carry structural loading and a link weighted portion positioned to provide counterweight for the lift device.

7. The boom assembly of claim 1, wherein the pair of sidewalls are sized only to carry structural loading, and wherein the discrete boss is coupled to at least one of the pair of sidewalls.

8. The boom assembly of claim 7, wherein the pair of sidewalls have a thickness sized only to carry structural loading.

9. The boom assembly of claim 8, wherein the discrete boss is at least one of positioned, shaped, and sized to provide counterweight for the lift device without undermining the functionality of the intermediate member.

10. A boom assembly, comprising:

a lower boom including an intermediate member end and a base end configured to be pivotally coupled to a lift device, the lower boom further including a boom base portion that comprises a tubular section positioned to carry structural loading and a boom weighted portion positioned to provide counterweight for the lift device, wherein the boom weighted portion is asymmetrically distributed along the length of the lower boom and biased toward the intermediate member end of the lower boom;

an intermediate member pivotally coupled to an end of the tubular section with a bracket;

an upper boom having a first end pivotally coupled to the intermediate member;

an intermediate link coupled directly between the upper boom and the lower boom; and an actuator coupled to the intermediate member with a lift pivot and the upper boom with a lift attaching frame;

wherein the intermediate member includes a base portion including a pair of sidewalls positioned to carry structural loading and a ballast positioned to provide counterweight for the lift device, wherein the ballast includes a discrete boss comprising at least one of a disk, a rib, and a ridge.

11. The boom assembly of claim 10, wherein the ballast is integrally formed with the intermediate member.

12. A lift device, comprising:

a chassis; and a boom assembly coupled to the chassis and moveable between a lowered position and an elevated position, comprising:

a lower boom including an intermediate member end and a base end coupled to the chassis, the lower boom further including a boom base portion that comprises a tubular section positioned to carry structural loading and a boom weighted portion positioned to provide counterweight for the lift device, wherein the boom weighted portion is asymmetrically distributed along the length of the lower boom and biased toward the intermediate member end of the lower boom;

an intermediate member pivotally coupled to an end of the tubular section with a bracket;

an upper boom including an intermediate end pivotally coupled to the intermediate member;

an intermediate link coupled directly between the upper boom and the lower boom; and an actuator coupled to the intermediate member with a lift pivot and the upper boom with a lift attaching frame;

wherein the intermediate member includes a base portion including a pair of sidewalls positioned to carry structural loading and a ballast positioned to provide counterweight for the lift device, wherein the ballast includes a discrete boss comprising at least one of a disk, a rib, and a ridge.

13. The lift device of claim 12, further comprising a first set of wheels coupled to the chassis and a second set of wheels coupled to the chassis, wherein at least one of the first set of wheels and the second set of wheels define a tip point.

14. The lift device of claim 13, wherein the lift device has a center of gravity and movement of the boom assembly between the lowered position and the elevated position shifts the center of gravity from a first lateral position to a second lateral position.

15. The lift device of claim 14, further comprising an implement coupled to a second end of the upper boom and configured to engage a payload, wherein the intermediate member carries structural loading imparted on the upper boom by the payload and the implement.

16. The lift device of claim 15, wherein the lower boom extends from the base end in a first direction and the upper boom extends from the intermediate end in an opposing direction such that the implement is positioned on a first lateral side of the tip point and the intermediate member is positioned on a second lateral side of the tip point when the boom assembly is in the lowered position.

17. The lift device of claim 16, further comprising a tail counterweight coupled to the chassis and positioned on the first lateral side of the tip point such that the ballast generates a moment that opposes the moment generated by the tail counterweight when the boom assembly is in the elevated position.

* * * * *